US007997113B2

(12) United States Patent
Dermody et al.

(10) Patent No.: US 7,997,113 B2
(45) Date of Patent: Aug. 16, 2011

(54) SYSTEM AND METHOD FOR HEMMING COMPONENTS

(75) Inventors: Thomas Dermody, Thornhill (CA); Michael W. Dorsett, Weyridge (GB)

(73) Assignee: Magna International Inc., Aurora (CA)

( * ) Notice: Subject to any disclaimer, the term of this patent is extended or adjusted under 35 U.S.C. 154(b) by 670 days.

(21) Appl. No.: 12/136,987

(22) Filed: Jun. 11, 2008

(65) Prior Publication Data

US 2008/0302161 A1 Dec. 11, 2008

(51) Int. Cl.
*B21D 41/02* (2006.01)
*B23P 11/00* (2006.01)

(52) U.S. Cl. ..... 72/316; 72/312; 72/420; 29/243.58

(58) Field of Classification Search ..... 72/306, 72/312, 316, 319, 320, 322, 323, 384, 419, 72/420, 441, 446; 29/243.5, 243, 57, 243.58
See application file for complete search history.

(56) References Cited

U.S. PATENT DOCUMENTS 4,901,555 A * 2/1990 Shimoichi ..... 72/322
5,150,508 A 9/1992 St. Denis
5,454,261 A 10/1995 Campian
6,305,208 B1 10/2001 Zimmer
6,418,771 B1 7/2002 Raffin et al.
6,446,478 B1 9/2002 Muller
6,487,888 B1 12/2002 Baulier et al.
6,508,099 B1 1/2003 Baulier et al.
6,578,401 B2 * 6/2003 Baulier ..... 72/312
6,584,661 B2 7/2003 Suzuki et al.
6,612,146 B2 9/2003 Saint Denis et al.
6,644,088 B1 11/2003 Ruescher et al.
6,739,168 B2 * 5/2004 Hario et al. ..... 72/306
7,614,269 B2 * 11/2009 Honda et al. ..... 72/17.3

* cited by examiner

*Primary Examiner* — Edward Tolan

(57) ABSTRACT

A hemming system and method is taught. The system and method employs tool platen assemblies comprising an anvil and one or more beam assemblies which are configured on the tool platen assembly and which tool platen assembly can be removed and replaced in the hemming system without the need for reconfiguration of the tool platen components. This allows for relatively rapid change over for the hemming system to hem different components. Further, the lift table of the hemming system includes a lift plate which moves the anvil through a predefined constant vertical stroke, but the start and end positions of that constant stroke length can be changed by inserting and removing a set of spacers from the anvil lift path. When the spacers are in the lift path, the lowered position and the raised position of the anvil are both higher than the corresponding lowered position and raised position when the spacers are removed from the lift path. The beam assemblies on the tool platen assembly include mounting surfaces to which both the preliminary hemming beam and the final hemming beams are mounted, one above the other, and the beam assemblies operate to move the hemming beams between a retracted position and a hemming position. The lift table design, and the beam assemblies, combine to provide relatively fast cycle times for complete hemming operations.

3 Claims, 7 Drawing Sheets

SYSTEM AND METHOD FOR HEMMING COMPONENTS

CROSS-REFERENCE TO RELATED APPLICATION

This application claims the benefit of U.S. Provisional Application No. 60/943,111, filed Jun. 11, 2007.

FIELD OF THE INVENTION

The present invention relates to a hemming system and method for hemming components. More specifically, the present invention relates to a hemming system and method which permits rapid change between respective setups to hem different components and which provides relatively short cycle times for the hemming operations.

BACKGROUND OF THE INVENTION

Systems for hemming the edges two or more metal components together to form a part are well known. Such systems are commonly used in the manufacture of various automotive body parts, such as doors, lift gates, hoods, etc., as well as in the manufacture of a variety of other manufactured goods.

When, for example, an automobile door is to be fabricated in a prior art hemming press, a previously stamped outer door panel is loaded onto an appropriately shaped anvil and the previously stamped inner door member is then placed atop the inside of the outer door panel and is held in place, with a clamp or other suitable mechanism, with the edges of the outer door panel and the inner door member overlying each other. The hemming press is then activated, moving an appropriately shaped first hemming beam through a complex motion, over and onto the anvil, to fold the edges of the outer door panel and inner door member over onto each other to a first extent, typically about forty-five degrees.

The first hemming beam is then removed and a second appropriately shaped hemming beam is then moved through another complex motion, over and onto the anvil, to complete the hem by further folding the edges of the outer door panel and inner door member over onto each other to complete the part.

While hemming provides numerous advantages compared to other joining techniques such as welding, hemming does suffer from some disadvantages. In particular, the setup positioning and alignment of the anvil, clamp and hemming beams and the setup of the shape and range of movements of these parts of the hemming machine are time consuming to accomplish and these actions must be performed each time it is desired to setup the machine to hem a different part. Thus, to be cost and/or time effective, a large run of parts needs to be hemmed during a run to amortize the setup costs for the hemming machine for that part. Therefore, hemming operations are not generally susceptible to versatile and/or just in time manufacturing processes.

Further, the complex movement of the hemming beams, which move over and onto the components on the anvil to perform the initial hemming operation, and again to perform the second hemming operation to complete the part, results in a relatively long minimum cycle time for the hemming process.

It is desired to have a hemming system and/or method which allows for the relatively efficient change over of the system and method to hem different parts and which provides for a relatively short minimum cycle time.

SUMMARY OF THE INVENTION

It is an object of the present invention to provide a novel system and method for hemming components which obviates or mitigates at least one disadvantage of the prior art.

According to a first aspect of the present invention, there is provided a hemming system for hemming the edges of two or more components, the system comprising: a lift table including a drive and a lift plate assembly, the drive operable to move the lift plate assembly through a fixed vertical stroke and operable to receive a tool platen assembly comprising an anvil, the lift plate assembly engaging the anvil through a lift path to move the anvil vertically through a stroke length corresponding to the fixed vertical stroke of the lift plate, the lift table being further operable to move a set of spacers into and out of the lift path to selectably move the anvil through the fixed stroke length from either a first or second vertical position; a clamp frame including a clamp carriage moveable vertically in the clamp frame, the clamp carriage receiving a clamp to engage and retain components to be hemmed which are loaded onto the anvil; and at least one beam assembly on the tool platen assembly, the at least one beam assembly including a mounting surface to which a preliminary hemming beam and a final hemming beam are mounted, one above the other, and the beam assembly being operable to move the mounting surface between a retracted position where the preliminary hemming beam and final hemming beam are distal the anvil and an operating position wherein the preliminary hemming beam and final hemming beam are adjacent the anvil such that the operative surface of one of the preliminary hemming beam and final hemming beams is positioned to engage the edge of the components as the anvil is moved vertically upward.

According to another aspect of the present invention, there is provided a method of hemming at least two components comprising the steps of: (i) loading the components to be hemmed onto an anvil at a lowered preliminary hemming position and bringing a complementary clamp into engagement with the components to retain the components on the anvil; (ii) moving at least one beam mounting surface, to which a preliminary hemming beam and a final hemming beam are mounted one above the other, from a retracted position distal the anvil to an operating position adjacent the anvil; (iii) moving the anvil upward, through a fixed stroke length, from the lowered preliminary position to raised preliminary position whereby the edges of the components to be hemmed engage the operative surface of the preliminary hemming beam to perform a preliminary hemming operation; (iv) returning the at least one beam mounting surface to the retracted position; (v) moving the anvil to a lowered final hemming position, the vertical difference between the lowered preliminary hemming position and the lowered final hemming position corresponding to the vertical distance between the operative surface of the preliminary hemming beam and the operative surface of the final hemming beam on the beam mounting surface; (vi) moving the at least one beam mounting surface from the retracted position to the operating position; (vii) moving the anvil upward, through the fixed stroke length, from the lowered final hemming position to a raised final hemming position whereby the edges of the components to be hemmed engage the operative surface of the final hemming beam to complete the hemming operation; (viii) returning the at least one beam mounting surface to the retracted position; and (ix) returning the anvil to the lowered preliminary hemming and disengaging the clamp to remove the hemmed components.

The present invention provides a hemming system and method which employs tool platen assemblies comprising an anvil and one or more beam assemblies which are configured on the tool platen assembly and which tool platen assembly can be removed and replaced in the hemming system without the need for reconfiguration of the tool platen components. This allows for relatively rapid change over for the hemming system to hem different components. Further, the lift table of the hemming system includes a lift plate which moves the anvil through a predefined fixed vertical stroke, but the start and end positions of that fixed stroke length can be changed by inserting and removing a set of spacers from the anvil lift path. When the spacers are in the lift path, the lowered position and the raised position of the anvil are both higher than the corresponding lowered position and raised position when the spacers are removed from the lift path. The beam assemblies on the tool platen assembly include mounting surfaces to which both the preliminary hemming beam and the final hemming beams are mounted, one above the other, and the beam assemblies operate to move the hemming beams between a retracted position and a hemming position. The lift table design, and the beam assemblies, combine to provide relatively fast cycle times for complete hemming operations.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
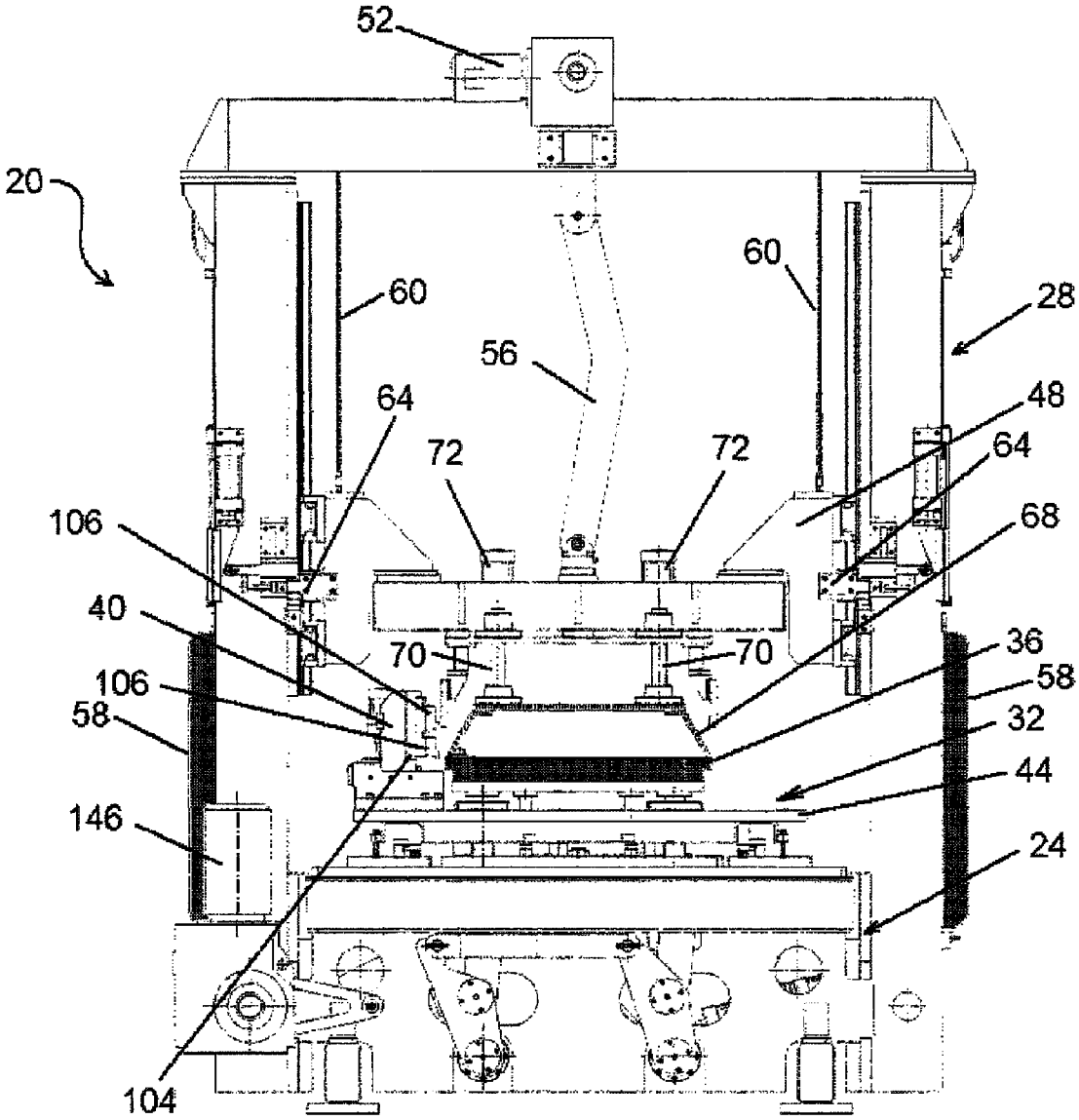
FIG. 1 shows a rear view of a hemming system in accordance the present invention.

A hemming system in accordance with the present invention is indicated generally at 20 in FIG. 1. System 20 includes a lift table 24 and a clamp frame 28.

Lift table 24, which is best in FIGS. 3 through 7, removably receives a tool platen assembly 32 which includes an anvil 36 and at least one beam assembly 40, each beam assembly being appropriately mounted, as described below, to a platen plate 44 which also forms part of tool platen assembly 32.

Clamp frame 28 includes a clamp carriage 48 which can be moved vertically along clamp frame 28 by a clamp lift motor 52 via a clamp lift arm 56. In the illustrated embodiment, a pair of gas-charged counter balances 58 are also connected to clamp carriage 48 via a pair of chains 60 to counter balance the static weight of clamp carriage 48.

Clamp carriage 48 is moved, by clamp lift motor 52 and clamp lift arm 56, between an open position (not shown), wherein clamp carriage 48 is raised within clamp frame 28 to allow hemmed parts to be removed from anvil 36 and unhemmed components to be loaded onto anvil 36, and a closed position (shown in FIG. 1) wherein clamp carriage 48 is lowered within clamp frame 28 so that hemming operations can be performed, as described below, on components loaded onto anvil 36.

Clamp carriage 48 further preferably includes a pair of locks 64 which can engage and disengage clamp frame 28 to lock clamp carriage 48 in the closed position during hemming operations and to release clamp carriage 48 when hemming operations have been completed, to allow clamp carriage 48 to return to the open position for unloading and loading.

A component clamp 68, complementary to anvil 36, is mounted to clamp carriage 48 via two or more guide posts 70 and one or more pneumatic cylinders 72 or any other suitable means as will occur to those of skill in the art. Pneumatic cylinders 72 allow clamp 68 to be brought into, and maintained in, contact with components to be hemmed which have been loaded onto anvil 36, after clamp carriage 48 has been moved to the nominal hemming position. Preferably, clamp 68 is mounted to guide posts 70 and pneumatic cylinders 72 with quick release connections, to allow clamp 68 to be changed when tool platen assembly 32 is changed, as described below.

Figure 2:
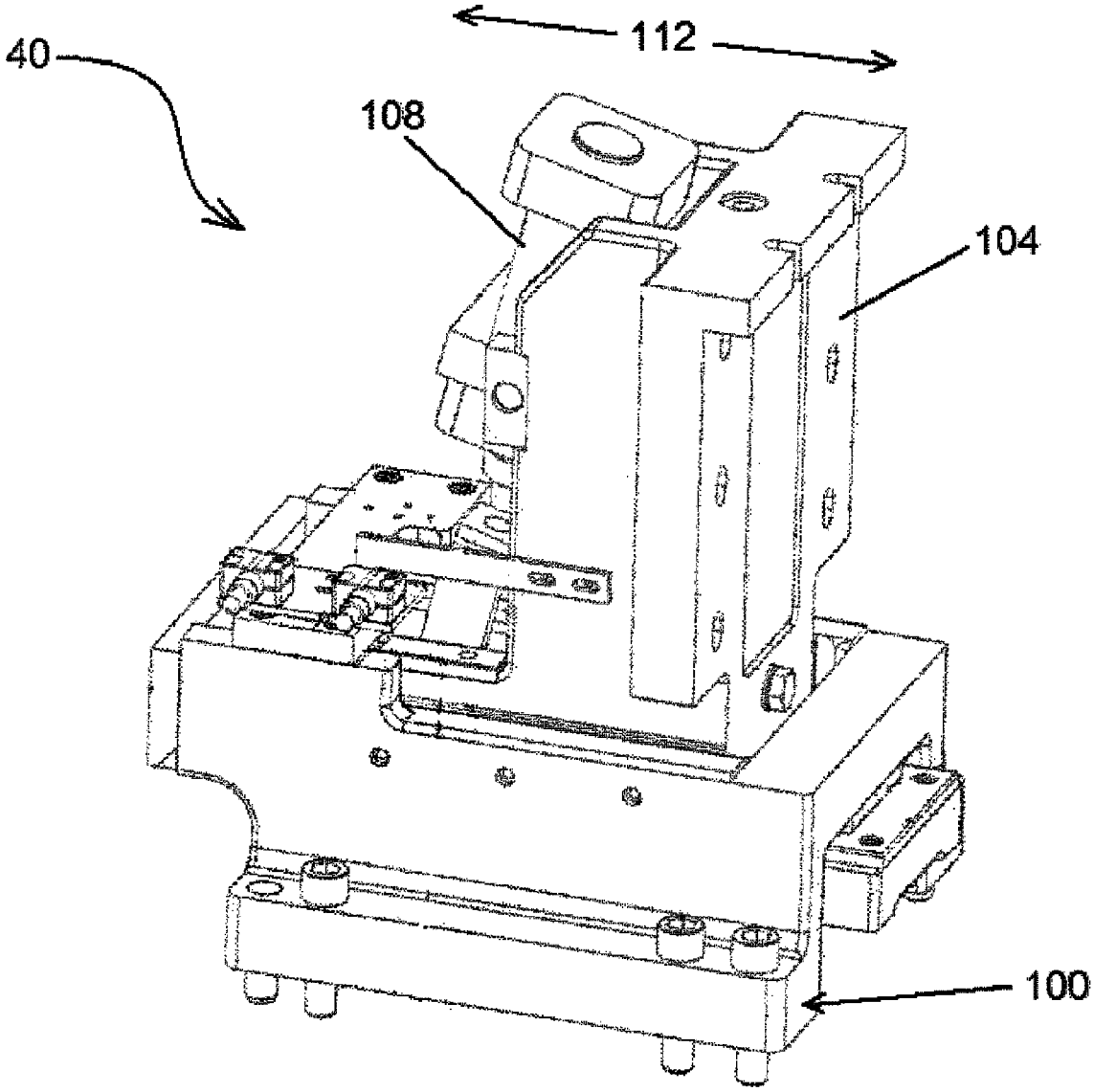
FIG. 2 shows perspective view of the side and top of a beam assembly employed with the hemming system of FIG. 1.

Each beam assembly 40, as shown in FIG. 2, includes base 100 which is mounted to platen plate 44 to affix beam assembly 40 in a desired position with respect to anvil 36. Each beam assembly 40 further includes a beam support member 104 to which the hemming beams 106 (shown in FIG. 1) are mounted. The design of hemming beams 106 is well known and will not be further discussed herein.

Beam support member 104 is moveable, via a pneumatic cylinder 108 or any other suitable means as will occur to those of skill in the art, in the directions indicated by arrow 112, with respect to base 100. When installed on platen plate 44, beam support member 104 can be moved by cylinder 108 between a hemming position, wherein beam support member 104 is adjacent anvil 36 to position the hemming beams 106 for hemming, and a free position wherein beam support member 104 is moved away from anvil 36 to allow anvil 36 to be repositioned (as described below) and/or to allow the loading of un-hemmed components or unloading of hemmed parts from system 20. Suitable indexing features, such as appropriate stops (not shown), operate between beam support member 104 and base 100 to define the free position and the hemming position and limit the movement of beam support member 104 between these positions.

Figure 3:
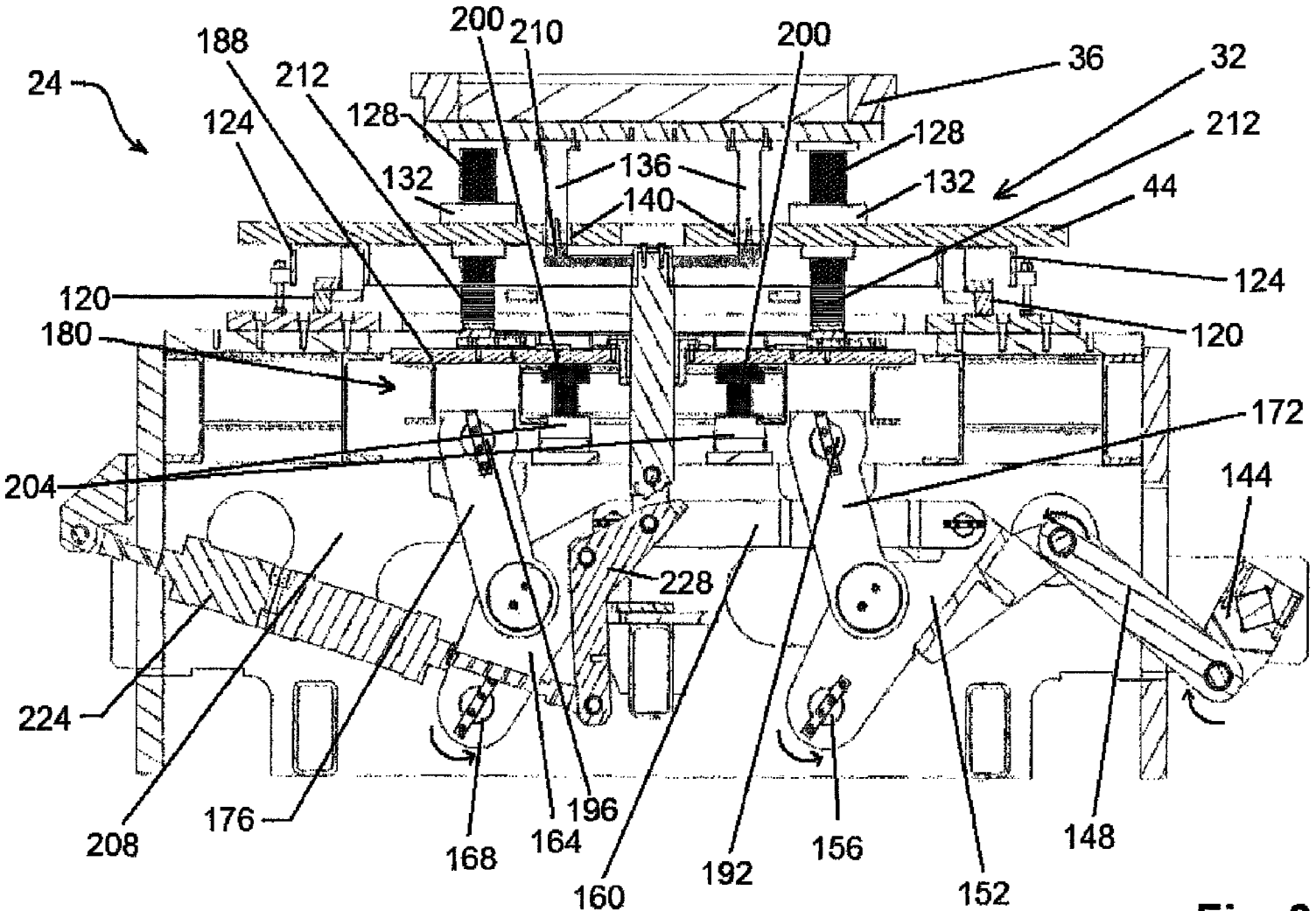
FIG. 3 shows a side cross section through a lift table of the hemming system of FIG. 1 with the anvil in a lowered preliminary hemming position.

Referring now to FIGS. 3 through 7, lift table 24 is better seen. As shown in FIG. 3, tool platen assembly 32 is installed onto table 24 via a set of complementary mounting features which, in this specific embodiment, comprise a pair of rails 120 that are mounted to the upper surface of table 24 and a complementary pair of tracks 124 that are mounted to the underside of platen plate 44. As is described in more detail below, tool platen assembly 32 can be removed from table 24 as a unit, along with beam assemblies 40 and anvil 36, maintaining the setup spacing and alignment of beam assemblies 40 and anvil 36 to allow for the relatively rapid change of system 20 from hemming one set of components to manufacture a first part to hemming another set of components to manufacture another part. As will be apparent to those of skill in the art, clamp 68 will also be changed when tool platen assembly 32 is changed.

All connections to pneumatic cylinders 108 or the like and to any electronic sensors or other components associated with tool platen assembly 32 are preferably of a suitable quick disconnect type, allowing for a tool platen assembly 32 for hemming a first set of components to be quickly and easily changed for a tool platen assembly 32 for hemming a second set of components.

Anvil 36 includes two or more posts 128 which extend through, and ride in bushings 132 in, platen plate 44 to allow anvil 36 to be raised and lowered vertically with respect to platen plate 44. Anvil 36 further includes at least one, and preferably more than one, lift spacer 136 each of which extends through a complementary aperture 140 in platen plate 44.

When anvil 36 is in the position illustrated in FIG. 3, platen assembly 32 can be removed from lift table 24 by inserting a temporary spacer (not shown) between anvil 36 and platen plate 44, to maintain anvil 36 at a sufficient height such that lift spacers 136 and posts 128 are disengaged from other components of lift table 24 (described below) and then tracks 124 of tool platen assembly 32 can be slid on rails 120 out of lift table 24 and onto a suitable support.

Similarly, another tool platen assembly 32 can be loaded, from a suitable support with its anvil 36 maintained at an appropriate height, onto lift table 24 by sliding its tracks 124 onto rails 120 of lift table 24. Once the tool platen assembly 32 is positioned with posts 128 and lift spacers 136 properly positioned with respect to the other components of lift table 24, as described below, the temporary spacer holding up anvil 36 can be removed. Any required pneumatic, electrical or other connections are also established between lift table 24 and devices on tool platen assembly 32.

In most circumstances, when a tool platen assembly 32 is removed and replaced with another tool platen assembly 32, a corresponding exchange of the clamp 68 mounted to clamp carriage 48 will also be performed. Assuming that the newly installed tool platen 32 and clamp 68 have previously been set up and operated in system 20, then hemming operations can typically be commenced without requiring further setup or alignment.

Figure 7:
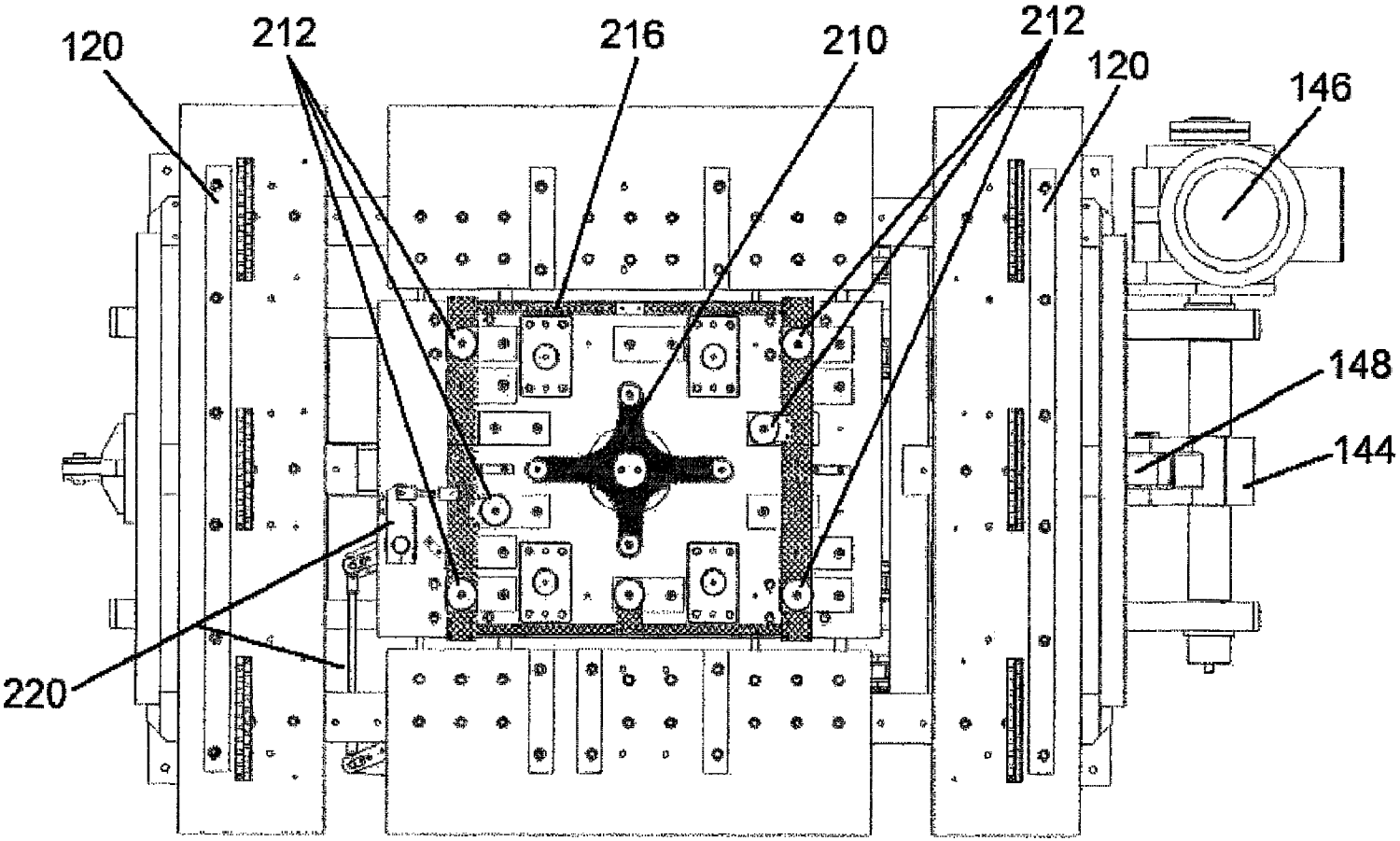
FIG. 7 shows a top view of the lift table of FIG. 3 with a tool platen assembly removed.

Lift table 24 includes a main lift system which comprises a main drive member 144 which is rotated by a suitable drive motor 146 (shown in FIG. 7). Main drive member 144 in turn rotates, via a link member 148, a first eccentric arm 152 about a pivot 156. As first eccentric arm 152 is rotated by main drive member 144, another link member 160 results in the synchronous rotation of a second eccentric arm 164 about a pivot 168.

Each of first eccentric arm 152 and second eccentric arm 164 are connected to a respective lift arm 172 and 176 which are, in turn, connected to a lift plate assembly 180. As will now be apparent to those of skill in the art, as main drive member 144 is rotated through ninety degrees in the direction indicated by the arrows in FIG. 3, lift plate assembly 180 is moved from the lowered position shown in FIG. 3 to the raised position shown in FIG. 4.

As will also now be apparent to those of skill in the art, while the illustrated embodiment includes two eccentric arms 152 and 164 and corresponding lift arms 172 and 176, depending upon the force required to be produced by lift plate assembly 180 to perform hemming operations, lift table 24 can be constructed with more or fewer eccentric arms and corresponding lift arms, as desired.

Lift plate assembly 180 includes a lift plate 188 and the upper ends of lift arms 172 and 176 are attached to pivots 192 and 196 which are, in turn, also mounted to lift plate assembly 180. Two or more lift plate guide posts 200 are also mounted to lift plate assembly 180 and guide posts 200 ride in bushings 204 attached to the frame 208 of lift table 24 to allow lift plate assembly 180 to move vertically with respect to lift table 24 while inhibiting horizontal movement of lift plate assembly 180.

Figure 4:
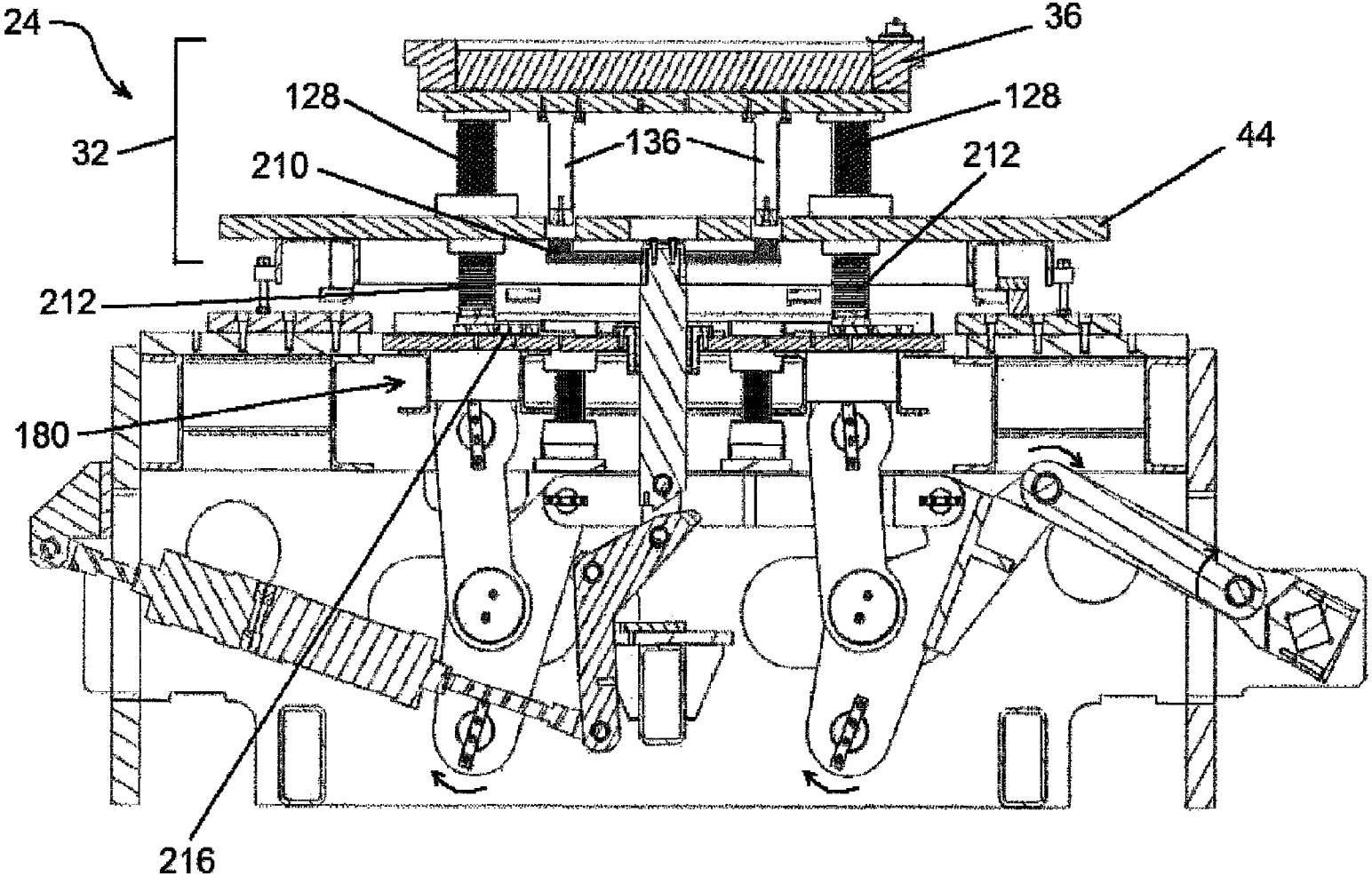
FIG. 4 shows the lift table of FIG. 3 with the anvil in a raised preliminary hemming position.

As should now be apparent to those of skill in the art, as main drive member 144 is rotated through the ninety degree revolution between the position illustrated in FIG. 3 and the position illustrated in FIG. 4, lift arms 172 and 176 move upward, moving lift plate assembly 180 from the lowered position, illustrated in FIG. 3, to the raised position illustrated in FIG. 4.

When lift plate assembly 180 is in the lowered position shown in FIG. 3, anvil 36 is supported by lift spacers 136 which rest on an anvil support 210. Lift spacers 136 thus support anvil 36 such that a slight gap exists between the bottoms of posts 128 and a set of spacers 212 atop lift plate 188. As lift plate 188 is moved upwards with lift plate assembly 180, lift plate 188 raises spacers 212 which, in turn, abut the bottom of posts 128 to raise anvil 36 from the lowered position, illustrated in FIG. 3, to the raised position illustrated in FIG. 4.

The position of anvil 36 in FIG. 3 corresponds to the lowered position of the preliminary hemming operation while the position of anvil 36 is FIG. 4 corresponds to the raised hemming position of the preliminary hemming operation.

The resulting movement of anvil 36 from the lowered hemming position of FIG. 3 to the raised hemming position of FIG. 4 will move components on anvil 36 vertically (along with clamp 68) with respect to hemming beams 106 installed on beam support members 40 on tool platen assembly 32.

In the present inventions the preliminary and final hemming beams are mounted, one above the other, on mounting surface 104 of beam support units 40. Accordingly, assuming that the preliminary hemming beam is mounted uppermost on beam support surfaces 104 and assuming that the beam mounting surfaces 104 have been moved to their operative position, in toward anvil 36, then the movement of anvil 36 and clamp 68 from the lowered position of FIG. 3 to the raised hemming position of FIG. 4 will bring the edges of the components to be hemmed into contact with the preliminary hemming beam and the edges of the components will be preliminarily folded to about forty five degrees.

Figure 5:
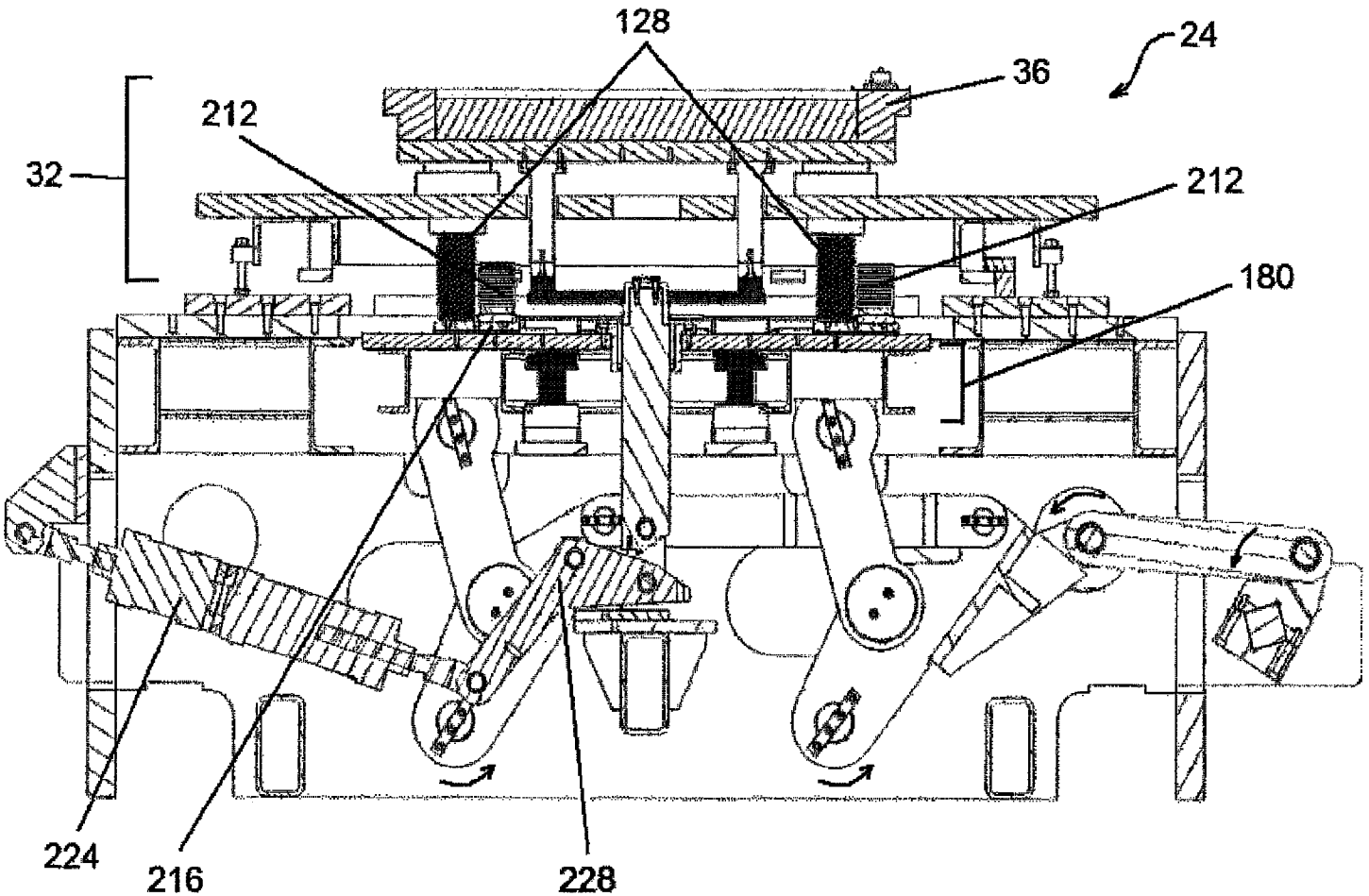
FIG. 5 shows the lift table of FIG. 3 with the anvil in a lowered final hemming position.

After the preliminary hemming operation has been performed, main drive member 144 continues to rotate through another ninety degrees, as indicated by the arrows in FIG. 4, and lift arms 172 and 176 move downward, moving lift plate assembly 180 and anvil 36 from the raised hemming position illustrated in FIG. 4, toward the lowered final hemming position shown in FIG. 5.

Figure 6:
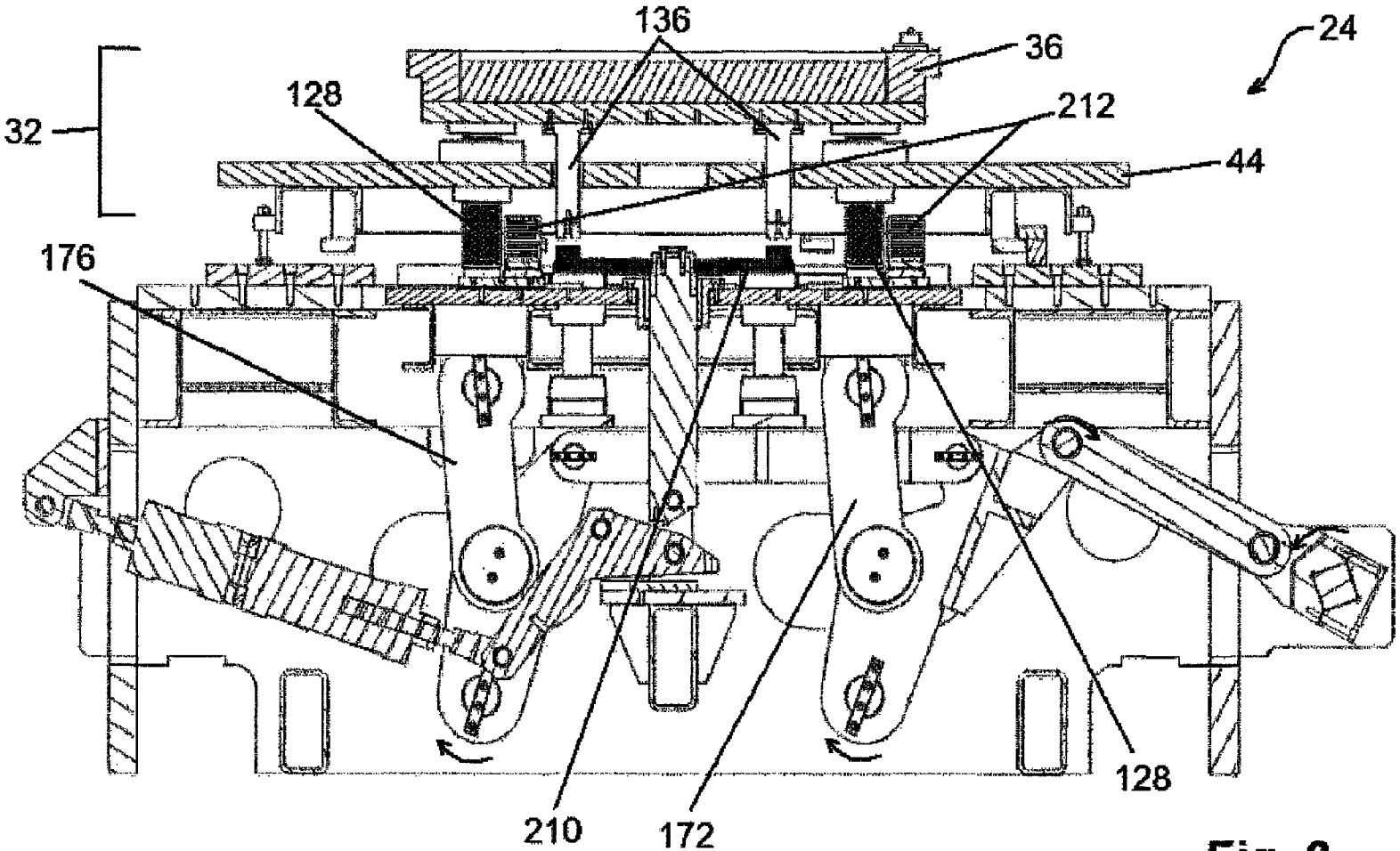
FIG. 6 shows the lift table of FIG. 3 with the anvil in a raised final hemming position.

As lift plate assembly 180 moves down, the mounting surfaces 104 of beam support units 40 are moved to a retracted position, away from anvil 36 to allow the height of anvil 36 and clamp 68 to be changed, as described below. Also, as lift plate assembly 180 continues to move down, anvil 36 is supported by lift spacers 136 and anvil support 210. When the load is off of spacers 212, spacers 212 are moved laterally (to the right in the illustrated configuration) to remove them from the lift path through posts 128 as shown in FIGS. 5 and 6. Specifically, as best seen in FIG. 7 spacers 212 are mounted to a shuttle frame 216 which can be moved laterally, between the position shown in FIGS. 3 and 4 and the position shown in FIGS. 5 and 6, by an actuator linkage 220, operated by a pneumatic cylinder (not shown) or other suitable actuator.

Once spacers 212 have been moved to the position shown in FIGS. 5 and 6, wherein spacers 212 are adjacent posts 128, main drive member 144 continues to rotate to the position shown in FIG. 5 and anvil support 210 is lowered and posts 128 abut lift plate 188. Anvil support 210 is lowered by a pneumatic cylinder 224, or the like, and linkage 228 and anvil 36 and clamp 68 are in the lowered final hemming position of FIG. 5.

To perform the final hemming operation, beam mounting surfaces 104 are moved to their operative position, in toward anvil 36 and, at this point, main drive member 144 is rotated counter clockwise (in the illustrated configuration) through ninety degrees and lift arms 172 and 176 move upward. The shortened lift path between lift plate 188 and anvil 36 (now comprising just posts 128) results in anvil 36 moving from the lowered final hemming position of FIG. 5 to the raised final hemming position of FIG. 6.

When the final hemming operation is complete, main drive member 144 is rotated counter clockwise another ninety degrees from the position shown in FIG. 6 and anvil support 210 is raised to support anvil 36 and clamp 68. As main drive member 144 continues to rotate, a clearance is opened between the bottoms of posts 128 and lift plate 188 and spacers 212 are moved into this clearance to again place them in the lift path. When spacers 212 are in place, anvil support 210 is lowered and table 24 is again in the lowered preliminary hemming position of FIG. 3.

At this point, beam mounting surfaces 104 are moved to their retracted position, locks 64 are released and clamp carriage 48 and clamp 68 are lifted in frame 28. The completed hemmed part can then be removed from anvil 36, by an operator, robot or any other suitable means and the next set of components to be hemmed can be loaded onto anvil 36 and the method described above can be performed again.

As should now be apparent, while lift table 24 has a fixed stroke through which lift plate assembly 180 is raised, by moving spacers 212 into and out of the lift path between lift plate 188 and posts 128, anvil 36 and clamp 68 can be lifted by this fixed stroke between two different sets of positions: between a lowered preliminary hemming position (FIG. 3) and a raised preliminary hemming position (FIG. 4); and between a lowered final hemming position (FIG. 5) and a raised final hemming position (FIG. 6).

The stroke length between the lowered preliminary hemming position and the raised preliminary hemming position is the same as the stroke length between the lowered final hemming position and the raised final hemming position, the stroke length in each case corresponding to the range through which lift plate assembly 180 is moved by lift arms 172 and 176.

Further, the distance between the lowered preliminary hemming position and the lowered final hemming position and the distance between the raised preliminary hemming position and the raised final hemming position each correspond to the height of spacers 212 and to the spacing between the operative surfaces of the preliminary hemming beam 106 and the final hemming beam 106 on beam support surface 104.

After loading an appropriate platen assembly 32 and corresponding clamp 68 onto lift table 24, when lift table 24 is in the lowered preliminary hemming position of FIG. 3, an embodiment of the method of the present invention which executes a complete hemming operation cycle comprises the following steps:

(i) the components to be hemmed are loaded onto anvil 36;

(ii) clamp carriage 48 is moved down frame 28 until clamp 68 is brought into engagement with the loaded components and locks 64 are extended to lock clamp carriage 48 in place;

(iii) beam support surfaces 104 on beam assemblies 40 are moved in towards anvil 36 to bring the hemming beams 106 to their operative position;

(iv) drive member 144 moves through a ninety degree revolution raising lift plate assembly 180 and thus raising anvil 36 up from the lowered preliminary hemming position to the raised preliminary hemming position to bring the edges of the loaded components into contact with the preliminary hemming beams to perform a preliminary hemming operation;

(v) drive member 144 moves through a further ninety degree revolution lowering lift plate assembly 180 and anvil 36 toward the lowered preliminary hemming position while beam support surfaces 104 on beam assemblies 40 are moved out away from anvil 36 to return the hemming beams 106 to their retracted position;

(vi) as lift plate assembly 180 is lowered, anvil 36 is supported by anvil support 210 and shuttle frame 216 is moved laterally to move spacers 212 out of the lift path of lift plate assembly 188. As drive member 144 completes its ninety degree revolution, anvil support 210 is lowered to lower anvil 36 and clamp 68 to the lowered final hemming position;

(vii) beam support surfaces 104 on beam assemblies 40 are moved in towards anvil 36 to bring the hemming beams 106 to their operative position;

(viii) drive member 144 moves through a ninety degree rotation in the opposite direction to the rotations of (iv) and (v), raising lift plate assembly 180 and thus raising anvil 36 up from the lowered final hemming position to the raised final hemming position to bring the edges of the loaded components into contact with the final hemming beams to complete the hemming operation;

(ix) drive member 144 moves through a further ninety degree revolution in the opposite direction to the rotations of (iv) and (v), lowering lift plate assembly 180 and anvil 36 toward the lowered preliminary hemming position. Anvil support 210 is lifted to support anvil 36 and shuttle frame 216 is moved to bring spacers 212 into the lift path of lift plate assembly 180. Beam support surfaces 104 on beam assemblies 40 are moved out away from anvil 36 to return the hemming beams 106 to their retracted position;

(x) locks 64 are released and clamp carriage 48 and clamp 68 are lifted; and (xi) the completed part is removed from anvil 36 by any suitable means.

As will be apparent, at the completion of step (xi), the method can recommence at step (i) to hem the next set of components.

In the discussion above, the preliminary hemming beam 106 is mounted above the final hemming beam 106 on beam mounting surfaces 104 of beam assemblies 40 such that the higher raised position (FIG. 4) that anvil 36 achieves corresponds to a raised preliminary hemming position and the lower raised position (FIG. 6) that anvil 36 achieves corresponds to a raised final hemming position. However, as will be apparent to those of skill in the art, the present invention is not so limited and the final hemming beam can be mounted on mounting surface 104 above the preliminary hemming beam if desired, in which case the higher raised position (FIG. 4) will correspond to a raised final hemming position and the lower raised position (FIG. 6) will correspond to a raised preliminary hemming position, with appropriate corresponding changes made to steps (i) through (xi) described above.

The hemming system and method of the present invention provides numerous advantages over the prior art. Specifically, it is contemplated that the present invention can provide much faster cycle times than have been generally available with the prior art. With the particular illustrated embodiment of the invention, total cycle times of less than fifteen seconds have been achieved to hem an automobile door.

Further, by employing tool platen assemblies 32 and corresponding clamps 68, tool change times are significantly reduced as the positioning and alignment of clamp 36 and beam assemblies 40 need only be performed once to configure a tool platen assembly. Once the initial set up and configuration has been performed for a tool platen assembly 32, that tool platen assembly 32 and its corresponding clamp 68 can be removed for storage, when not needed, and can be reloaded onto system 20, when needed again, in only a few minutes as the positioning and alignment of anvil 36 and beam assemblies 40 does not change when a tool platen assembly 32 is removed from and replaced on system 20.

The present invention provides a hemming system and method which employs tool platen assemblies comprising an anvil and one or more beam assemblies which are configured on the tool platen assembly and which tool platen assembly can be removed and replaced in the hemming system without the need for reconfiguration of the tool platen components. This allows for relatively rapid change over for the hemming system to hem different components. Further, the lift table of the hemming system includes a lift plate which moves the anvil through a predefined constant vertical stroke, but the start and end positions of that constant stroke length can be changed by inserting and removing a set of spacers from the anvil lift path. When the spacers are in the lift path, the lowered position and the raised position of the anvil are both higher than the corresponding lowered position and raised position when the spacers are removed from the lift path. The beam assemblies on the tool platen assembly include mounting surfaces to which both the preliminary hemming beam and the final hemming beams are mounted, one above the other, and the beam assemblies operate to move the hemming beams between a retracted position and a hemming position. The lift table design, and the beam assemblies, combine to provide relatively fast cycle times for complete hemming operations.

The above-described embodiments of the invention are intended to be examples of the present invention and alterations and modifications may be effected thereto, by those of skill in the art, without departing from the scope of the invention which is defined solely by the claims appended hereto.

We claim:

1. A hemming system for hemming the edges of two or more components, the system comprising:

a lift table including a drive and a lift plate assembly, the drive operable to move the lift plate assembly through a fixed vertical stroke and operable to receive a tool platen assembly comprising an anvil, the lift plate assembly engaging the anvil through a lift path to move the anvil vertically through a stroke length corresponding to the fixed vertical stroke of the lift plate, the lift table being further operable to move a set of spacers into and out of the lift path to selectably move the anvil through the fixed stroke length from either a first or second vertical position;

a clamp frame including a clamp carriage moveable vertically in the clamp frame, the clamp carriage receiving a clamp to engage and retain components to be hemmed which are loaded onto the anvil; and at least one beam assembly on the tool platen assembly, the at least one beam assembly including a mounting surface to which a preliminary hemming beam and a final hemming beam are mounted, one above the other, and the beam assembly being operable to move the mounting surface between a retracted position where the preliminary hemming beam and final hemming beam are distal the anvil and an operating position wherein the preliminary hemming beam and final hemming beam are adjacent the anvil such that the operative surface of one of the preliminary hemming beam and final hemming beams is positioned to engage the edge of the components as the anvil is moved vertically upward.

2. The hemming system of claim 1 wherein the tool platen assembly and a complementary clamp can be removed and replaced on the hemming system without requiring realignment of the anvil or hemming beams.

3. A method of hemming at least two components comprising the steps of:

(i) loading the components to be hemmed onto an anvil at a lowered preliminary hemming position and bringing a complementary clamp into engagement with the components to retain the components on the anvil;

(ii) moving at least one beam mounting surface, to which a preliminary hemming beam and a final hemming beam are mounted one above the other, from a retracted position distal the anvil to an operating position adjacent the anvil;

(iii) moving the anvil upward, through a fixed stroke length, from the lowered preliminary position to a raised preliminary position whereby the edges of the components to be hemmed engage the operative surface of the preliminary hemming beam to perform a preliminary hemming operation;

(iv) returning the at least one beam mounting surface to the retracted position;

(v) moving the anvil to a lowered final hemming position, the vertical difference between the lowered preliminary hemming position and the lowered final hemming position corresponding to the vertical distance between the operative surface of the preliminary hemming beam and the operative surface of the final hemming beam on the beam mounting surface;

(vi) moving the at least one beam mounting surface from the retracted position to the operating position;

(vii) moving the anvil upward, through the fixed stroke length, from the lowered final hemming position to a raised final hemming position whereby the edges of the components to be hemmed engage the operative surface of the final hemming beam to complete the hemming operation;

(viii) returning the at least one beam mounting surface to the retracted position; and (ix) returning the anvil to the lowered preliminary hemming and disengaging the clamp to remove the hemmed components.

* * * * *